US007648420B2

(12) United States Patent
Stroppiana

(10) Patent No.: US 7,648,420 B2
(45) Date of Patent: Jan. 19, 2010

(54) MULTI-PURPOSE SPORTS FACILITY

(75) Inventor: Fernando Stroppiana, Grinzane Cavour (IT)

(73) Assignee: Mondo S.p.A., Alba Frazione Gallo (IT)

( * ) Notice: Subject to any disclaimer, the term of this patent is extended or adjusted under 35 U.S.C. 154(b) by 0 days.

(21) Appl. No.: 11/282,500

(22) Filed: Nov. 18, 2005

(65) Prior Publication Data

US 2006/0105847 A1 May 18, 2006

(30) Foreign Application Priority Data

Nov. 18, 2004 (IT) ..... TO2004A0812

(51) Int. Cl.
*A63C 19/10* (2006.01)
*A63C 19/00* (2006.01)

(52) U.S. Cl. ..... 472/88; 472/92; 473/415

(58) Field of Classification Search ..... 472/85, 472/89, 92, 94, 136, 137; 473/415; 52/6–9
See application file for complete search history.

(56) References Cited

U.S. PATENT DOCUMENTS

| | | | | |
|---|---|---|---|---|
| 3,995,079 | A * | 11/1976 | Haas, Jr. | 428/17 |
| 5,655,974 | A * | 8/1997 | Bair | 473/278 |
| 5,921,032 | A * | 7/1999 | Labinski | 52/9 |
| 2005/0107172 | A1* | 5/2005 | Morell | 472/92 |

FOREIGN PATENT DOCUMENTS

| | | | |
|---|---|---|---|
| CN | 1218127 | A | 6/1999 |
| EP | 1 158 099 | A2 | 11/2001 |
| EP | 1 319 753 | A2 | 6/2003 |
| EP | 1 371 779 | A1 | 12/2003 |
| EP | 1 375 750 | A1 | 1/2004 |
| EP | 0 874 105 | B1 | 8/2004 |
| EP | 0 913 524 | B1 | 8/2004 |
| EP | 1 486 613 | A1 | 12/2004 |
| WO | WO 02/18706 | A1 | 3/2002 |

OTHER PUBLICATIONS

"Rules of the Game" by the Diagram Group, Paddington Press Ltd, 1874, 4 pages.*
Jiangsu Co-Creation Grass Co., Ltd., Jun. 19, 2004, retrieved Jan. 9, 2006 from URL: http://www.ccgrass.com/ccgrass_com/english, 5 pages. XP002361846.
The Patent Office of the People's Republic of China, The First Notification of Office Action, Issue Date Dec. 5, 2008, 6 pages.
Zhao, Ruilin, "Stadium field", People's Sports Press. Press date, Jul. 31, 1991, pp. 1-12.

* cited by examiner

*Primary Examiner*—Kien T Nguyen
(74) *Attorney, Agent, or Firm*—Seed IP Law Group PLLC

(57) ABSTRACT

A multi-purpose sports facility is provided with a common base structure comprising a plurality of areas, each of which constitutes a track, pitch or court for practicing a respective sports activity. The invention enables people to learn and practice sport, choosing from the activities most widely practiced the one that they prefer and is tracks, pitches or courts most suitable for their own physical and mental aptitudes.

21 Claims, 6 Drawing Sheets

MULTI-PURPOSE SPORTS FACILITY

BACKGROUND OF THE INVENTION

1. Field of the Invention

The present invention relates to sports facilities.

2. Description of the Related Art

Sports facilities having synthetic surfaces such as artificial turf can better withstand wear and tear than natural grass. The synthetic surfaces currently in use, however, are not particularly suited for different sports nor are they easily configurable for multiple purposes.

BRIEF SUMMARY OF THE INVENTION

In one embodiment, the invention enables people to learn and practise sport, choosing from amongst the most widely practised activities the one that they prefer and is most suitable for their own physical and mental aptitudes.

According to the present invention, tone embodiment provides a multi-purpose sports facility.

In the currently preferred embodiment, the multi-purpose facility according to the invention makes it possible to start from the basic sport of running and evaluate the physical resources, aptitude, and resistance manifested by the individual person (with particular attention paid to young people aged between six and eighteen) to enable him or her to choose the most suitable sports activity from a set of activities comprising, for example, athletics, soccer, volleyball, tennis, basketball, and handball.

A youngster who starts by taking up running is then able to train by practising all the activities on a single multi-purpose facility with learning functions. Subsequently, he is able to specialize in one or more sports activities so as to be able to develop gradually his own capabilities and achieve increasingly satisfactory results.

The multi-purpose facility according to the invention enables the drawing-up of training programmes for the various sports, with the added possibility of it being set out according to different schemes (in particular as regards the choice of the sports), as dictated by the preferences, and the local customs and cultures of different geographical areas. The multi-purpose facility in question can be set up at a low cost so as to make it available (for example, by renting) at contained costs and for the benefit of entities such as schools, local authorities, and sports clubs.

In the configuration according to a preferred embodiment, the sports facility comprises in any case, peripherally, a running track, for example of a fairly short length (typically 200 meters) and/or with a number of lanes, which encloses inside it one or more pitches or courts for practising different sports activities.

In a particularly preferred way, the sports facility in question is obtained using as base structure a synthetic-grass covering comprising a sheet substrate with a plurality of filiform formations extending from the substrate for simulating the grass blade of natural turf, as well as a particulate filling material, or infill, dispersed between the filiform formations so as to keep the filiform formations themselves in a substantially upright condition.

Preserving the same basic structure and modifying parameters such as, for example, the extension of the filiform formations and the nature, density, as well as the thickness of the particulate infill, it is possible to bestow on different areas of the multi-purpose sports facility characteristics that are different according specifically to the various sports activities which are to be carried out thereon, possibly in accordance with the respective national and international sports federations.

BRIEF DESCRIPTION OF THE SEVERAL VIEWS OF THE DRAWING(S)

The invention will now be described, purely by way of non-limiting example, with reference to the annexed plate of drawings, in which.

DETAILED DESCRIPTION OF THE INVENTION

Figure 1:
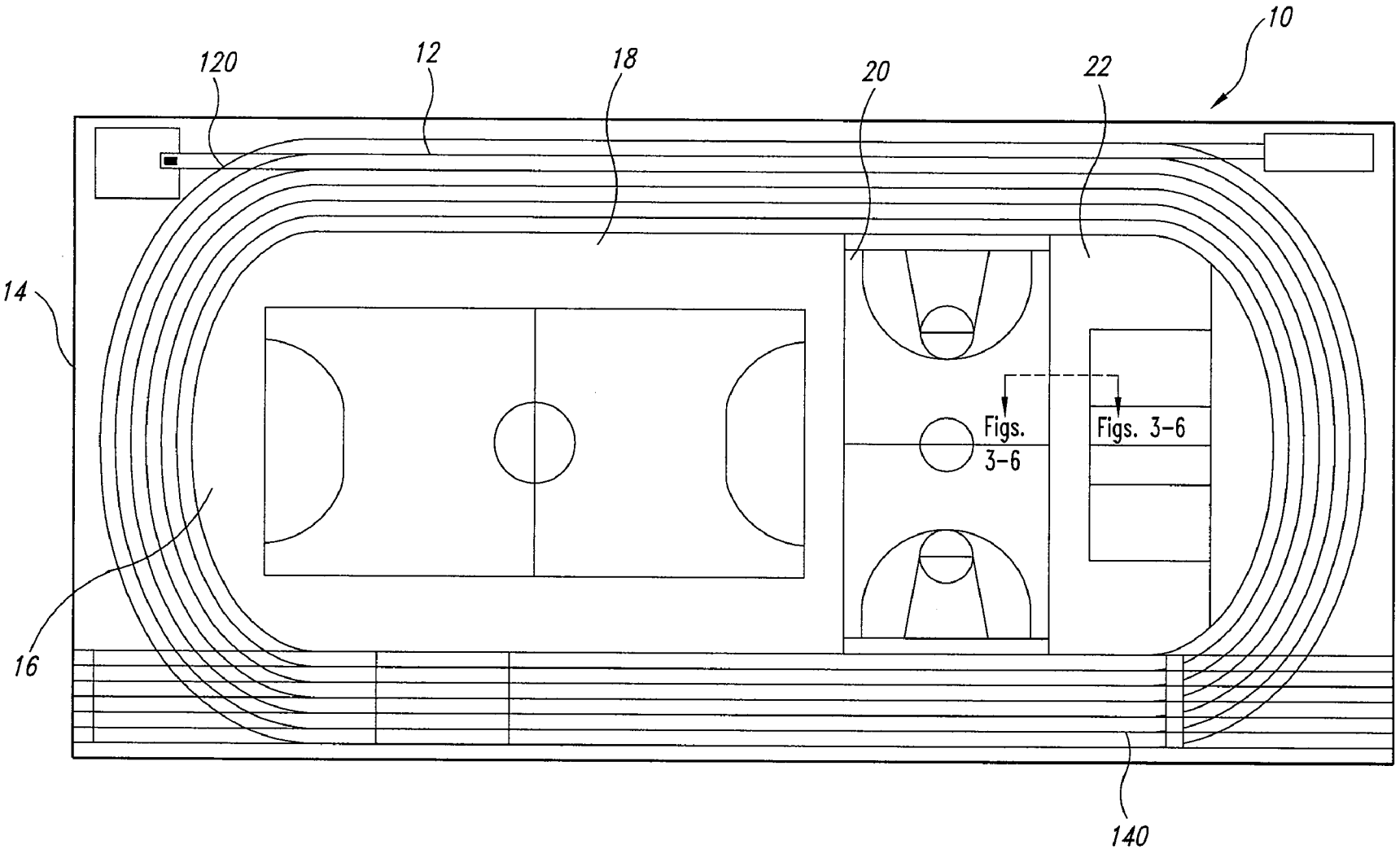
FIG. 1 is a general plan view of a multi-purpose sports facility according to one embodiment of the invention.

In the attached plate of drawings, the reference number 10 designates as a whole a multi-purpose sports facility comprising, in the example of embodiment illustrated herein:

- an athletics track 12 constituted by an annular running track, for example of a fairly short length (typically 200 meters) and/or with a number of lanes (from two, to six, to eight), which is circumscribed by a boundary 14, here having a generally rectangular shape, which encloses an internal space 16; and
- one or more fields, pitches or courts 18, 20, 22 for practising different sports activities made in the space 10 delimited by the running track 12.

For purpose of illustration, without in any way limiting the scope of the invention, the dimensions of the rectangular boundary 14 may typically be in the region of 100-110 meters in length by 40-50 meters in width, which corresponds to a total surface of approximately 5000 $m^2$.

Advantageously, the running track 12 has, along its major sides, one or more rectilinear stretches 120, 140, which extend practically throughout the length of the boundary 14 and can be used, for example, for short-distance running (for example 100m) or else for jumping activities (long jumping, pole vaulting, hop-step-and-jump, etc.).

As regards the areas 18, 20, 22, the example of embodiment to which FIG. 1 refers envisages that the area 18 is a football pitch (five-a-side football), having for example dimensions of 40×20 m. The area 20 may be instead a basketball court with typical dimensions in the region of 28×15 m. The area 22 is a volleyball court with typical dimensions in the region of 9×18 m.

Of course, both the number of pitches and courts 18, 20, 22 and their arrangement, the dimensions indicated, as well as the nature of the areas in question are intended purely to provide an example and hence in no way limit the sphere of protection of the invention.

Figure 2:
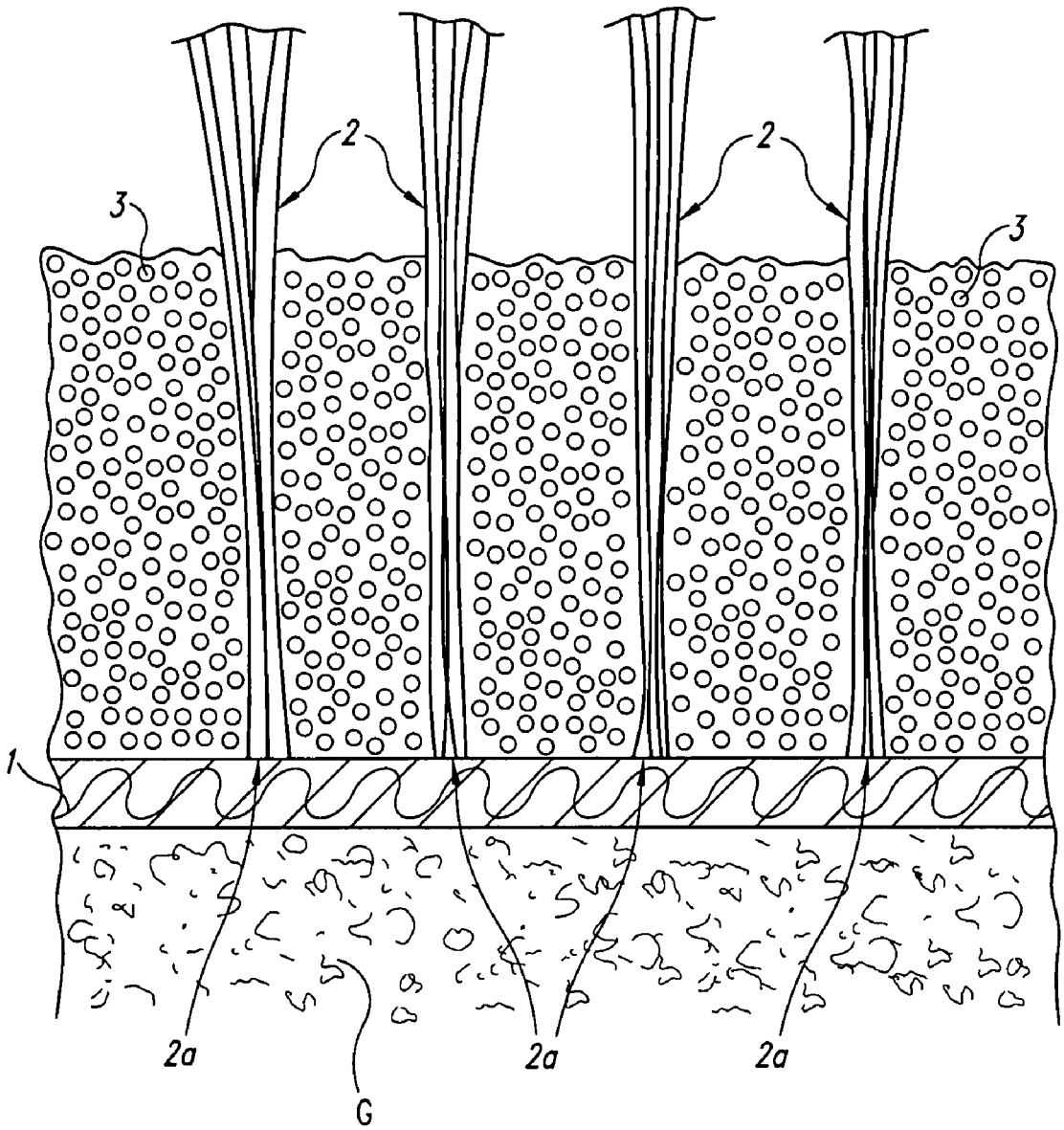
FIG. 2 is a schematic reproduction, in an ideal vertical cross section, of a portion of the base surface of the sports facility of FIG. 1.

In a particularly preferred way, all the various pitches, tracks, etc. 12, 18, 20, 22 illustrated herein (or at least one subset thereof) are obtained using, as base structure, a structure of synthetic-grass covering of the type illustrated in FIG. 2.

This is a structure comprising a sheet substrate 1 with a plurality of filiform formations 2 extending from the substrate 1 so as to simulate the grass blade of natural turf, and a particulate filling material, or infill, 3 dispersed between the filiform formations 2 so as to keep the filiform formations 2 themselves in a substantially upright condition.

In a particularly preferred way, the particulate infill 3 consists of a substantially homogeneous mass of a granular material chosen in the group consisting of polyolefin-based materials and vinyl polymer-based materials, for example of the type described in EP-A-1 158 099, in the name of Mondo S.p.A., the assignee of the instant application.

Figure 3:
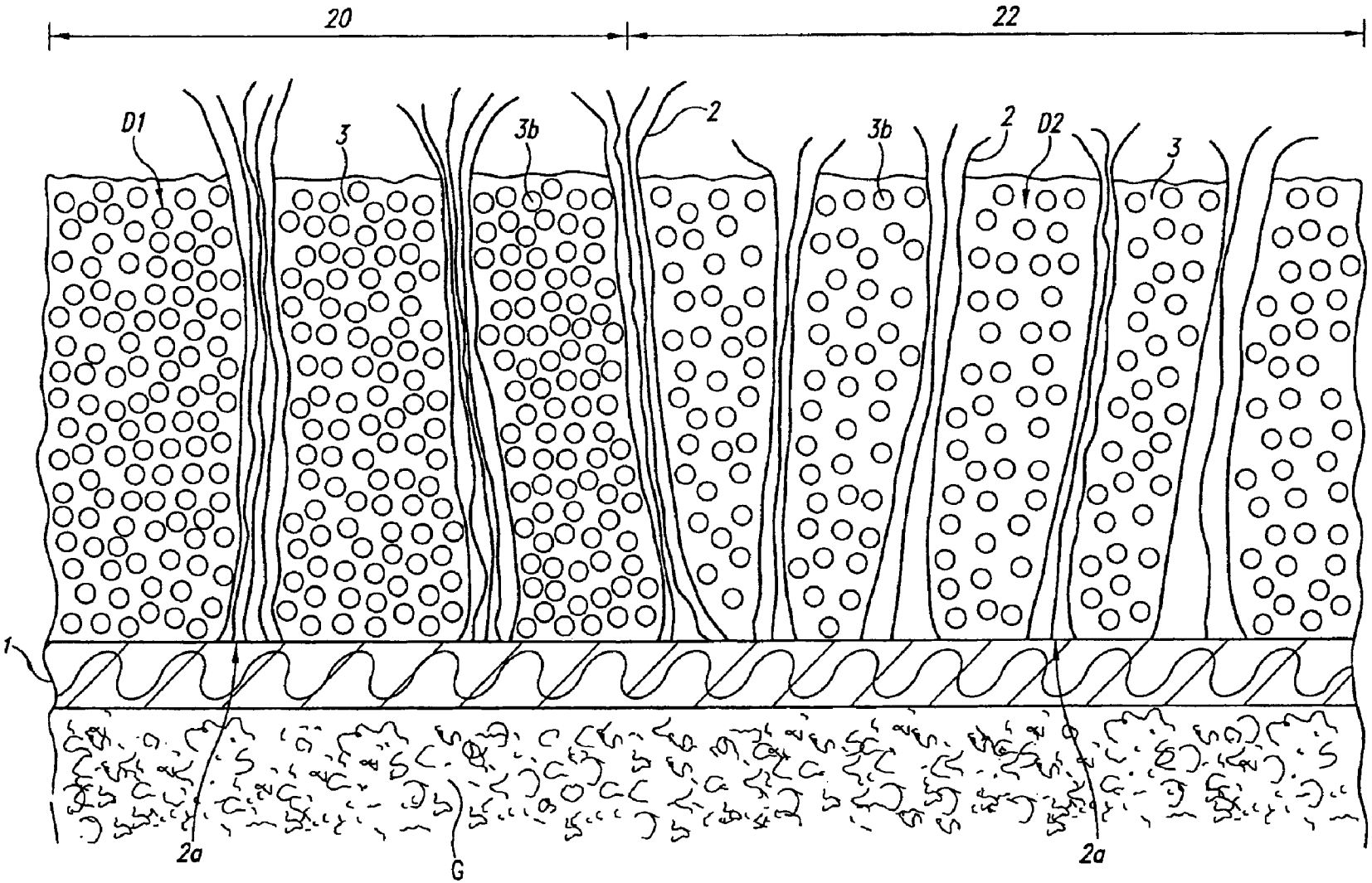
FIG. 3 is a cross-sectional illustration of FIG. 1, taken where indicated, of a basketball and volleyball surface having a common substrate and different infill densities and filiform characteristics, according to one illustrated embodiment.

Recourse to this structure makes it possible to bestow on the various surfaces 12, 18, 20, 22 biomechanical characteristics differentiated according to the particular specialities that are to be practised on a given pitch or track. This is obtained by modifying the characteristic parameters of the constituent elements of the structure (e.g., the filiform formations 2 and the infill 3), as illustrated in FIG. 3.

Figure 4:
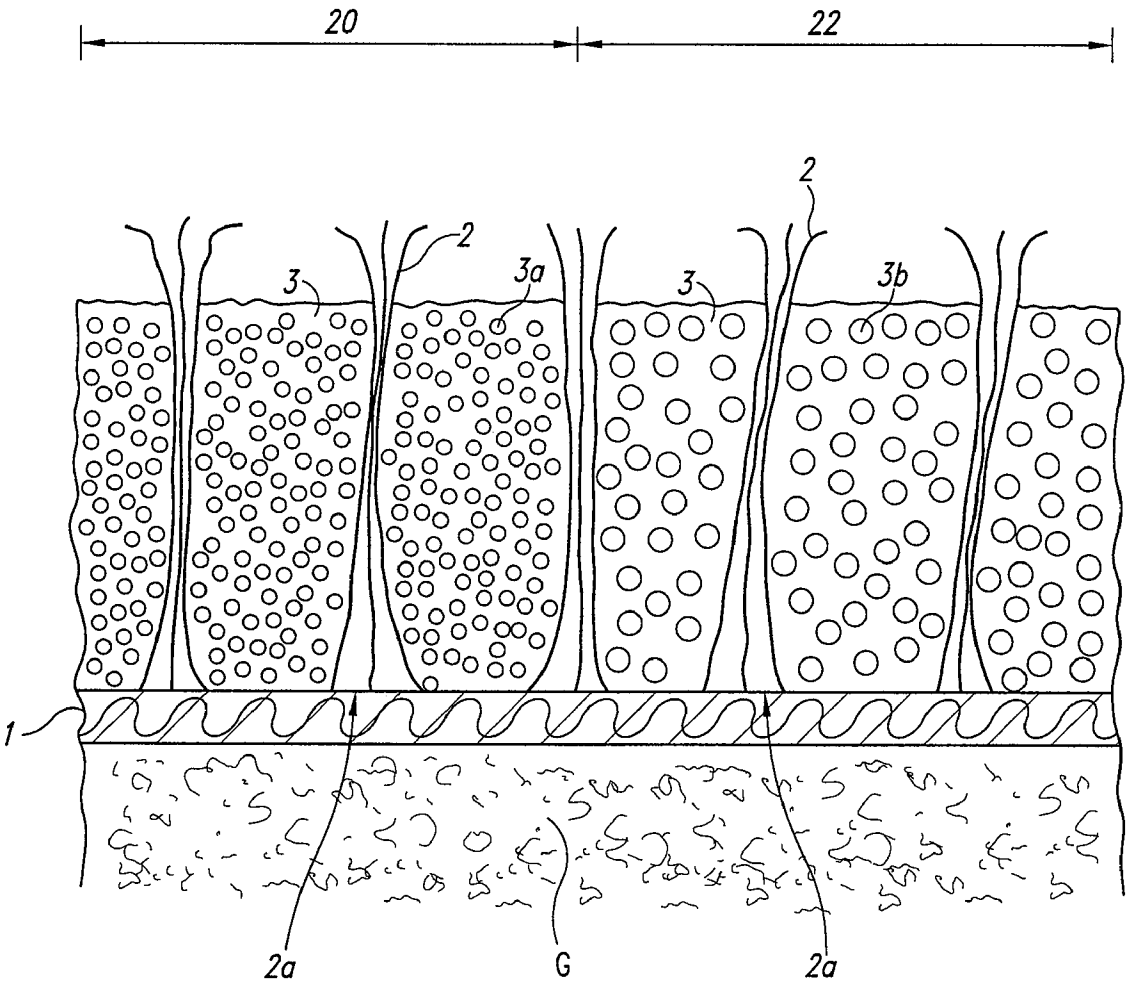
FIG. 4 is a cross-sectional illustration of FIG. 1, taken where indicated, of a basketball and volleyball surface having a common base structure and different infill grain size, according to one illustrated embodiment.

According to FIG. 4, for example, a first parameter is the grain size 3*a*, 3*b* of the infill 3. It is therefore possible, for example, to reserve smaller values of grain size 3*a* to pitches or tracks for which a higher compactness (i.e., a greater "hardness") is desired, as in the case of the basketball court, such as the pitch 20, whilst greater values of grain size 3*b* are usually reserved to pitches for which characteristics of greater softness or pliancy are desired, such as the pitch 22.

Figure 5:
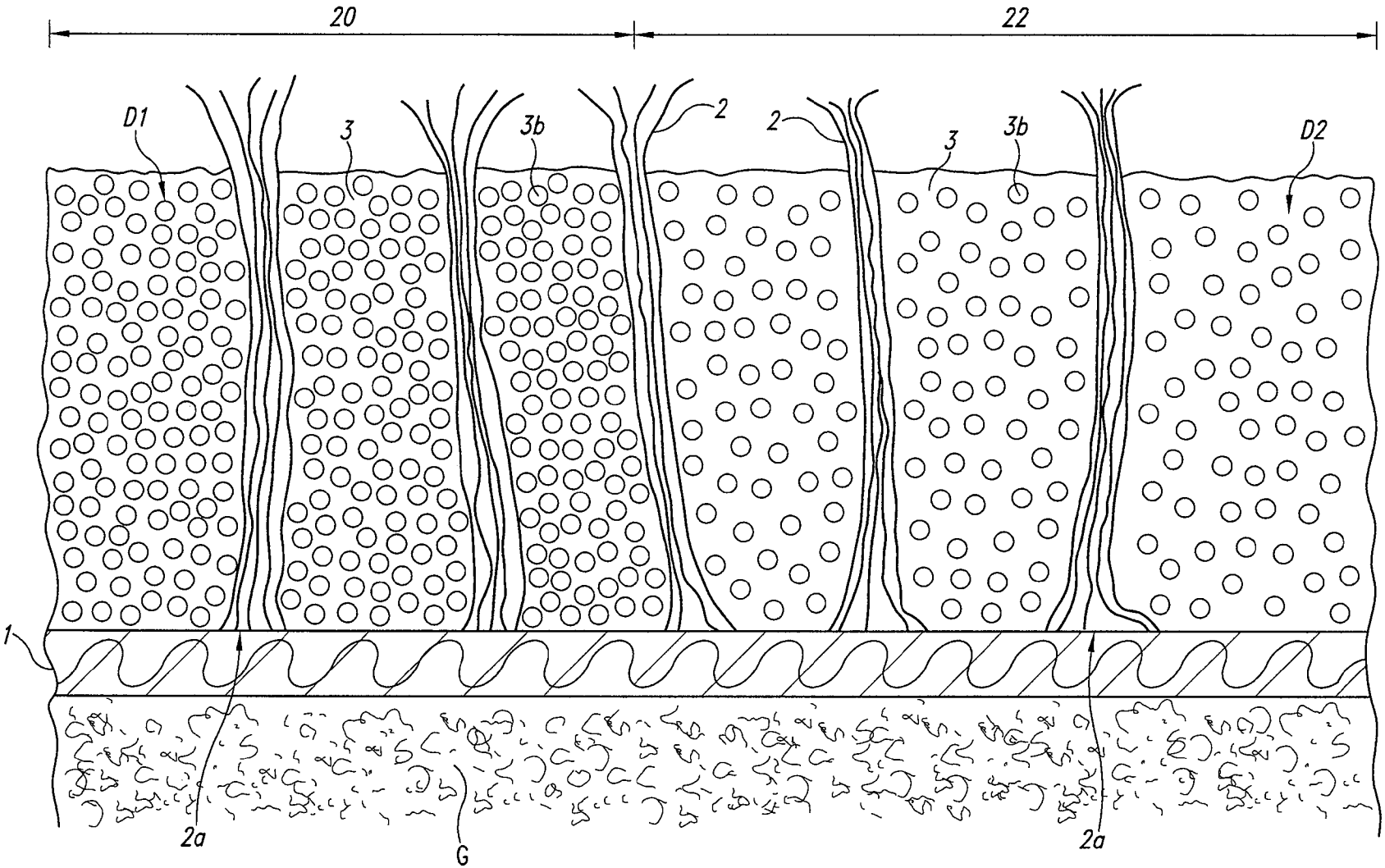
FIG. 5 is a cross-sectional illustration of FIG. 1, taken where indicated, of a basketball and volleyball surface having a common base structure and different infill densities, according to one illustrated embodiment.

As illustrated in FIG. 5, substantially similar considerations apply as regards the density D1, D2 of the infill 3. For example, the density D1 is greater than the density D2. The same considerations are valid as regards the apparent density D1, D2 of the infill 3 and as regards its grain size 3*a*, 3*b*, as well as the amount of dispersed material.

In another embodiment, the infill 3 may consist simply of sand, or of a filling with high hardness, or else, in a particularly preferred way, of a polyolefin-based material or a vinyl polymer-based material. Particularly preferred choices for said material are polyethylene, recycled polyolefin material or else a recycled vinyl polymer.

It will be appreciated that the filling materials can be the same as one another or else different for the various playing surfaces 12, 18, 20, 22.

Figure 6:
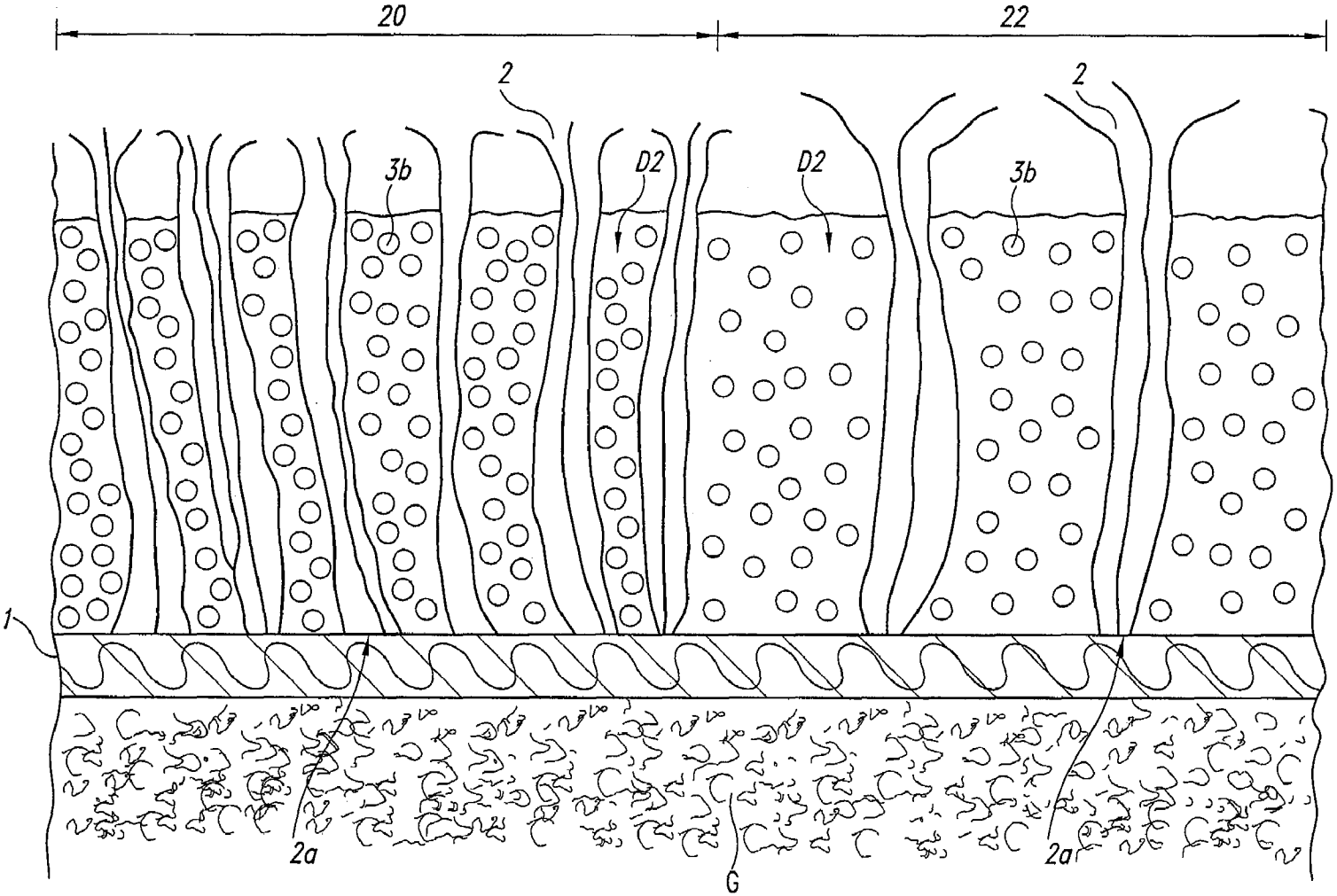
FIG. 6 is a cross-sectional illustration of FIG. 1, taken where indicated, of a basketball and volleyball surface having a common substrate and different filiform characteristics, according to one illustrated embodiment.

As illustrated in FIG. 6, other parameters on which it is possible to adjust in order to modify selectively the biomechanical characteristics of the various tracks, pitches or courts 12, 18, 20, 22 are, for example, the density (points/$m^2$) and/or the length of the filiform formations 2, understood as the distance between their proximal ends (designated by 2*a*), which are anchored to the substrate 1, and their distal ends, which extend upwards.

In a particularly advantageous embodiment of the multi-purpose sports facility, it is envisaged to use, for two or more of the tracks or pitches 12, 18, 20 and 22, a sheet substrate 1 with a plurality of filiform formations 2 extending from the substrate 1 with uniform characteristics. In this case, differentiation of the biomechanical characteristics of the various areas 12, 18, 20, 22 is obtained by primarily adjusting the characteristics of the infill 3 and/or the characteristics of distribution of the material itself on the substrate 1.

The multi-purpose sports facility described herein presents the further advantage of being suited both as regards convenience of laying, and as regards a possible convenient reconfiguration of the various tracks, pitches or courts (variation in number, position, orientation, and characteristics thereof, also according to requirements of use that can vary in time), as well as regarding a convenient operation of dismantling, with practically complete recycling of the component materials, according to the modalities described, for example, in EP-A-1 319 753.

Advantageous variant embodiments of the structure of covering which can be used for the multi-purpose sports facility according to the invention are described in EP-A-1 375 750, EP-A-1 371 779 and in the European patent application filed under No. 03425369 or else in EP-A-0 874 105 and EP-A-0 913 524.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

Of course, without prejudice to the principle of the invention, the details of construction and the embodiments may vary widely with respect to what is described and illustrated herein, without thereby departing from the scope of the present invention.

The invention claimed is:

1. A multi-purpose sports facility comprising:

a plurality of areas, each of said areas being a track, pitch or court for practicing a respective sports activity, each of said areas having respective biomechanical characteristics differentiated according to the respective sports activity practiced thereon; and a base structure common to the plurality of areas, the base structure being composed of a sheet substrate and an infill, the sheet substrate having a plurality of filiform formations extending from the sheet substrate;

the infill being positioned above the sheet substrate and dispersed between said filiform formations so as to maintain the filiform formations in substantially upright conditions wherein at least two areas included in the plurality of areas exhibit differences in the base structure in at least one of:

a length of the filiform formations extending from said sheet substrate, a grain size of respective ones of said infill dispersed between said filiform formations, and a density of said infill dispersed between said filiform formations, wherein the at least two areas included in the plurality of areas of the base structure have respective biomechanical characteristics in response to the differences in the base structure.

2. The sports facility according to claim 1, wherein one of said areas is an annular running track bounding a respective internal space, said respective internal space housing at least another area of said plurality of areas.

3. The sports facility according to claim 2, wherein said running track comprises at least one rectilinear side and is circumscribed by a boundary, at least one elongated rectilinear stretch coupled to said running track extends adjacent to a side of said boundary.

4. The sports facility according to claim 1, wherein said areas take a form of tracks, pitches or courts to practice a respective sport thereon, the respective sport is at least one of running, athletics, soccer, five-a-side football, volleyball, tennis, basketball, and handball.

5. The sports facility according to claim 1, wherein said infill consists of a substantially homogeneous mass of a granular material chosen from at least one of polyolefin-based materials and vinyl polymer-based materials.

6. The sports facility according to claim 1, wherein said areas comprise at least two areas that have an identical type of sheet substrate with identical lengths of filiform formations extending from the sheet substrate, the two areas differing from one another in at least one of the size of respective ones of said infill dispersed between said filiform formations and the density of said infill dispersed between the filiform formations.

7. A multipurpose sports facility comprises:

a first area having a first type of infill dispersed between a plurality of first type filiform formations, said first type of filiform formations extending substantially vertically beyond the first type of infill, said first type of infill being of a first density;

a second area having a second type of infill dispersed between a plurality of second type of filiform formations, said second type of filiform formations extending substantially vertically beyond the second type of infill, said second type of infill being of a second density then the first type of infill causing the first area to have different biomechanical properties than the second area; and a common sheet substrate underlying the first and second areas.

8. The multipurpose sports facility according to claim 7 wherein the first type of infill are substantially homogenous particles of a first dimension and the second type of infill are substantially homogenous particles of a second dimension, such that the particles have a different grain size.

9. The multipurpose sports facility according to claim 7 wherein the first type of infill and second type of infill are independently polymeric material, sand or a mixture thereof.

10. The multipurpose sports facility according to claim 9 wherein the polymeric material is polyolefin-based materials and vinyl polymer-based materials.

11. The multipurpose sports facility according to claim 7 wherein the first type of filiform formation and the second type of filiform formations are different.

12. The multipurpose sports facility according to claim 7 wherein the second area is encompassed by the first area.

13. The multipurpose sports facility according to claim 12 wherein the first area comprises tracks.

14. The multipurpose sports facility according to claim 12 wherein the second area is a basketball court.

15. A multipurpose facility comprising:

a contiguous common infill layer extending across a plurality of areas;

a first area for a first sport that is one of the plurality of areas, the first area having a plurality of filiform formations to simulate grass that are spaced from each other with a first density of filiforms per square meter extending from the layer with an infill material dispersed between the respective filiform formations; and a second area for a second, different sport that is one of the plurality of areas and located adjacent the first area, the second area having the plurality of filiform formations to simulate grass that are spaced from each other with a second, different density of filiforms per square meter extending from the layer with the infill material dispersed between the respective filiform formations, the first and second areas being part of the contiguous common substrate and having a common infill layer surface in a same horizontal plane.

16. The facility of claim 15 wherein a length of the plurality of filiform formations in the first area is different than a length of the plurality of filiform formations in the second area.

17. The facility of claim 15 wherein a grain size of the infill material in the first area is different than the grain size of the infill material in the second area.

18. A multipurpose sports facility comprising:

a contiguous common substrate extending across a plurality of areas;

a first area for a first sport that is one of the plurality of areas, the first area having a plurality of filiform formations extending from the substrate with an infill material positioned above the substrate and dispersed between the respective filiform formations; and a second area for a second, different sport that is one of the plurality of areas and located adjacent the first area, the second area having the plurality of filiform formations extending from the substrate with the infill material positioned above the substrate and dispersed between the respective filiform formations, the first and second areas being part of the contiguous common substrate, wherein the first area and the second area exhibit different biomechanical characteristics by each having a different density of the infill layer material dispersed between the filiform formations.

19. The facility of claim 18 wherein the infill comprises a granular material of at least one of polyolefin-based materials and vinyl polymer-based materials.

20. The facility according to claim 18, further including a plurality of granular particles within the infill material, the size of the granular particles varying from the first area to the second area over the contiguous common substrate extending across the plurality of areas.

21. The facility according to claim 18 wherein the length of the filiform formations extending from the contiguous common substrate have a different length in the first area than in the second area.

* * * * *